US009326583B2

(12) United States Patent
Pires et al.

(10) Patent No.: US 9,326,583 B2
(45) **Date of Patent: *May 3, 2016**

(54) APPLICATOR SYSTEM

(71) Applicant: ZEN DESIGN SOLUTIONS LIMITED, Kowloon (CN)

(72) Inventors: Leo Clifford Pires, Basking Ridge, NJ (US); Roger Hwang, Maple (CA); Rahul Bose, New Delhi (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/911,807

(22) Filed: Jun. 6, 2013

(65) Prior Publication Data

US 2013/0263880 A1 Oct. 10, 2013

Related U.S. Application Data

(63) Continuation-in-part of application No. 12/944,168, filed on Nov. 11, 2010, now Pat. No. 8,469,041.

(60) Provisional application No. 61/260,233, filed on Nov. 11, 2009.

(51) Int. Cl.

| | |
|---|---|
| ***A45D 40/26*** | (2006.01) |
| ***A46B 13/00*** | (2006.01) |
| ***A46B 9/02*** | (2006.01) |

(52) U.S. Cl.

CPC ..... *A45D 40/265* (2013.01); *A45D 40/262* (2013.01); *A46B 9/021* (2013.01); *A46B 13/00* (2013.01); *A45D 2200/207* (2013.01); *A46B 2200/1053* (2013.01)

(58) Field of Classification Search

CPC ..... A46B 2200/1046; A46B 2200/1053; A46B 2200/106

See application file for complete search history.

(56) References Cited

U.S. PATENT DOCUMENTS

| | | | | |
|---|---|---|---|---|
| 4,056,111 | A | 11/1977 | Mantelet | |
| 4,397,326 | A | 8/1983 | Formica | |
| 6,565,276 | B1 | 5/2003 | Diaz | |
| 8,007,192 | B2 | 8/2011 | Huang | |
| 8,021,065 | B2 | 9/2011 | Lou | |
| 8,469,041 | B2 * | 6/2013 | Pires et al. | 132/218 |
| 2002/0084707 | A1 | 7/2002 | Tang | |
| 2006/0032046 | A1 | 2/2006 | Nathan et al. | |
| 2006/0032512 | A1 | 2/2006 | Kress et al. | |
| 2006/0272667 | A1 | 12/2006 | Wyatt et al. | |
| 2006/0279181 | A1 | 12/2006 | Gueret | |
| 2008/0011316 | A1 | 1/2008 | Malvar et al. | |
| 2008/0260450 | A1 * | 10/2008 | Sanchez | 401/126 |

* cited by examiner

*Primary Examiner* — Robyn Doan

(74) *Attorney, Agent, or Firm* — Patterson & Sheridan, LLP

(57) ABSTRACT

The present invention generally relates to an applicator system and in particular, relates to an applicator system capable of moving the applicator head in an irregular motion. The applicator system is provided with a mechanism that gives the applicator an irregular motion during usage thereby resulting in better application. The applicator system of the present invention is configured to move in an irregular motion that has no obvious pattern and may be used for cosmetic and care applications such as mascara application, scrubbing of lips, cleaning of nails, etc.

12 Claims, 13 Drawing Sheets

APPLICATOR SYSTEM

CROSS-REFERENCE TO RELATED APPLICATION

This application is continuation-in-part of U.S. application Ser. No. 12/944,168 filed on Nov. 11, 2010, which claims benefit of U.S. Provisional Application Ser. No. 61/260,233 filed Nov. 11, 2009, all of which are incorporated by reference in their respective entireties.

BACKGROUND

1. Field of the Invention

Embodiments of the present invention generally relate to an applicator system and in particular, relate to an applicator system capable of moving the applicator head in an irregular motion. The applicator system is provided with a mechanism that gives the applicator head an irregular motion, having no obvious pattern, during usage thereby resulting in better application. The applicator system of the present invention may be used for cosmetic and care applications such as mascara application, scrubbing of lips, cleaning of nails etc.

2. Description of the Related Art

Various types of applicators and systems have been designed and developed in the recent years. Conventionally, applicators include a stem, at one end of which is connected an applicator head and at the other end is provided a handle for gripping. Continuous innovations in this area are being made to provide the user with an applicator that gives him/her a better application and makes the whole application effortless to the consumer.

Cosmetic applicator such as a mascara applicator deposits and distributes the product i.e. mascara all over the lashes. As mascara, inherently, is a product that is difficult to apply because of the sensitive target area of application, it is desirable that no clumping of product occurs and the lashes are separated and combed evenly. However, all the desired effects are not possible with a single mascara brush. This is because the eyelashes are soft, flexible, delicate and in close proximity to very sensitive eye tissue.

Further, a user requires moving his/her hands in a particular way to achieve a particular effect on the lashes. Mascara brushes that rotate during application are known. U.S. Pat. No. 4,056,111 describes a motor-driven, rotatable mascara brush. The motor may comprise a rewindable spiral spring (that is, a clock-work motor) or a battery powered motor may be used. U.S. Pat. No. 4,397,326 describes a non-motorized mascara brush, the head of which is free to rotate and does so when the brush head contacts the eyelashes during application. It is the act of brushing that causes the rotation. U.S. Pat. No. 6,565,276 discloses a battery powered motor, rotating mascara brush head.

There have also been innovations in these applicators where the applicator head is caused to vibrate in a particular direction. However, all such known applicators provide the rod to be moved in either a vibration/rotational or an oscillating motion. It is found by the inventors of the present invention that the movement of applicator in an irregular motion results in better application of the product and therefore the user is provided with an even application and in case of mascara application there occurs no clumping as well as better separation of lashes. However, this irregular motion becomes difficult for a user to emulate with his/her hand due to the sensitivity of the area where applied. Therefore, there is a need in the art for an applicator that is able to cause the applicator head to move in an irregular motion thereby giving the desired effect without the user having to put in any effort.

SUMMARY

The present invention generally relates to an applicator system and in particular, relates to an applicator system capable of moving the applicator head in an irregular motion. Irregular motion being a motion that has no obvious pattern. The applicator system of the present invention is provided with a mechanism that gives the applicator an irregular motion during usage thereby resulting in better application.

According to an embodiment of the invention, the applicator system comprises of a gripping member, an applicator head, a vibration means and at least one flexible element. The gripping member has a proximal end and a distal end. The proximal end of the gripping member is free while the distal end is connected to the applicator head. The vibration means is disposed between the gripping member and the applicator head. The at least one flexible element is disposed between the vibration means and the applicator head. The at least one flexible element translates the vibrations of the vibration means into an irregular motion of the applicator head. The applicator system may further comprise an actuating means to actuate the mechanism of conversion of vibration of vibrating means to irregular motion. The actuating means may be a push button, a dialer, a slider, a button, or any suitable actuating means.

According to yet another embodiment of the invention, the at least one flexible element may be disposed such that it is an integral part of the gripping member.

According to yet another embodiment of the invention the gripping member may comprise a hollow chamber which accommodates the vibration means.

According to yet another embodiment of the invention, the at least one flexible element may be disposed such that it is an integral part of the hollow chamber.

According to yet another embodiment of the invention during usage of the applicator system the actuating means is actuated which causes the vibrating means to vibrate, as the vibration starts to travel along the gripping member, the at least one flexible element disposed between the vibrating means and the applicator head converts the vibrations into irregular motion which is transferred to the applicator head thereby causing the applicator head to move in an irregular motion during usage/application.

According to another embodiment of the invention the applicator system comprises of a gripping member, a stem, an applicator head, a vibration means and at least one flexible element. The stem has a proximal end and a distal end. The proximal end of the stem is connected to the gripping member while the applicator head is connected to the distal end of the stem. The gripping member has a hollow chamber which accommodates the vibration means. The at least one flexible element is disposed between the vibration means and the applicator head. The at least one flexible element translates the vibrations of the vibration means into an irregular motion of the applicator head. The applicator system may further comprise an actuating means to actuate the mechanism of conversion of vibration of vibrating means to irregular motion. The actuating means may be a push button, a dialer, a slider, a button, or any suitable actuating means.

According to yet another embodiment of the invention the at least one flexible element may be disposed such that it is an integral part of the stem. The flexible element may be disposed at the proximal end of the stem and/or at the distal end of the stem.

According to yet another embodiment of the invention the at least one flexible element is disposed as a separate part secured to the proximal end of the stem and/or the distal end of the stem.

According to yet another embodiment of the invention the stem may be formed by a combination of flexible element and rigid elements in a suitable sequence.

According to yet another embodiment of the invention during usage of the applicator system the actuating means is actuated which causes the vibrating means to vibrate, as the vibration starts to travel along the gripping means and the stem, the at least one flexible element disposed between the vibrating means and the applicator head converts the vibrations into irregular motion which is transferred to the applicator head thereby causing the applicator head to move in an irregular motion during usage/application.

According to yet another embodiment of the invention the resultant irregular motion of the applicator head may be used in various applications such as scrubbing of skin, easy product dispensing on surface, nail cleansing, massaging, etc.

According to yet another embodiment of the invention the applicator head when used for mascara application comprises of a base body on which are a plurality of bristles extending from its circumference. The bristles may extend out in parallel longitudinal rows on the applicator head. Alternatively, the bristles may extend radially parallel or in any other suitable arrangement.

In accordance with yet another embodiment of the invention the applicator system may further comprise a propel-repel assembly for propelling and repelling the applicator. The applicator in storage condition may be present inside the gripping member and gets propelled when the user wishes to use it. The propel-repel assembly may comprise a propel-repel mechanism to cause propelling and repelling of the applicator.

In accordance with an embodiment of the invention the mechanism to propel and repel the applicator may comprise a slider mechanism, a ball-point mechanism, conventional lipstick mechanism, a threaded screw mechanism or any other suitable mechanism that causes propelling and repelling of the applicator.

According to yet another embodiment of the invention the propel-repel mechanism of the applicator is actuated by a suitable actuating means. The actuating means may be the top cap, a dialer, a button, a slider or spring actuated actuator or any other suitable actuating means.

According to yet another embodiment of the invention there is provided a container comprising a receptacle for containing the product and the applicator system as described in all the above detailed embodiments for applying the product.

In accordance with yet another embodiment of the present invention the applicator system may be used for cosmetic and care applications such as for mascara application, loose powder application, baked or pressed product, scrubbing of lips, cleaning of nails etc.

In accordance with yet another embodiment of the present invention the applicator system may comprise an applicator head wherein the applicator head is a brush.

In accordance with yet another embodiment of the invention the applicator head may be freely rotatable around its own axis. Further, the applicator head may comprise of an applicator element and stem connector such that the applicator element is attached to the stem connector in a suitable manner. As an exemplary embodiment the applicator element and the stem connector may be connected such that the applicator element is freely movable around the stem connector and during usage the irregular motion gets transferred to the applicator element.

In accordance with yet another embodiment of the invention, depending upon the substance being used in the receptacle, a variety of sizes and shapes of the applicator head can be utilized. The applicator head may be constructed of a porous or non-porous rubber, fabric mesh, felt material, polymeric material. foamed polymers, sponge material, Hytrel™, TPE or any other suitable material. Also, the applicator could have any suitable shape depending on the kind of application required. It could have a shape other than cylindrical such as ovular, tapered or any other suitable shape.

The vibration means of the present invention may comprise a vibration motor, an electromagnet, a piezoelectric or an ultrasonic vibrator. In particular, the vibration means can comprise any pneumatic, hydraulic, ultrasonic, electronic, or electromechanical system that is capable of producing vibration.

These and further aspects which will be apparent to the expert of the art are attained by an applicator system in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
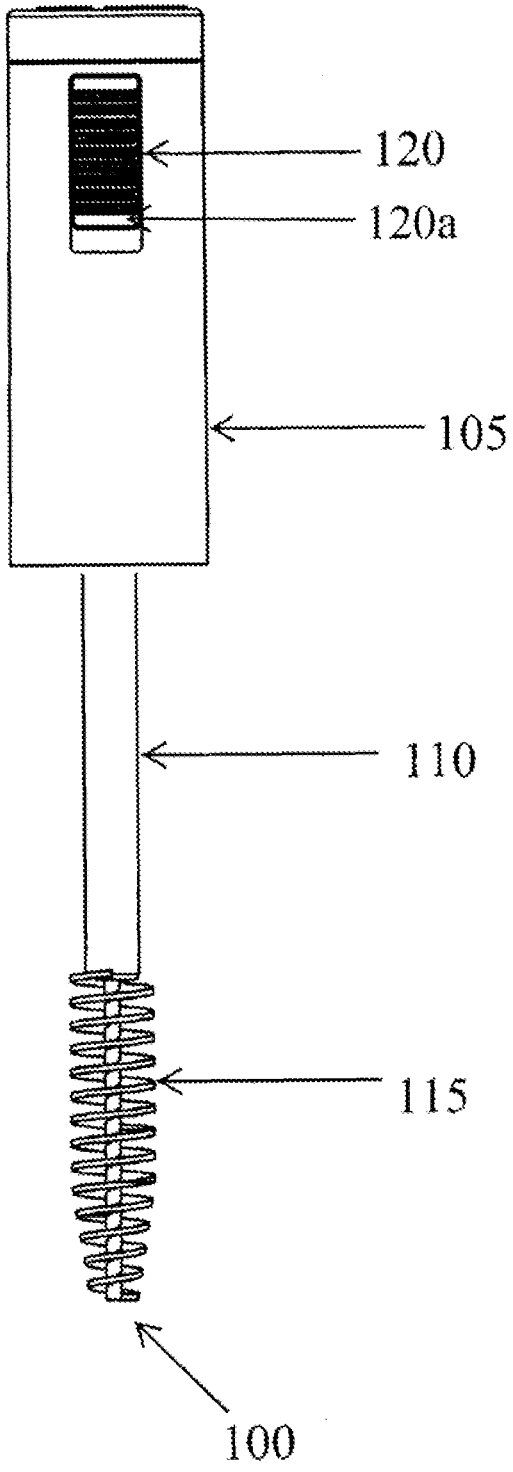
FIG. 1 illustrates an isometric view of an applicator system according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

FIG. 1 is one embodiment of the present invention showing an isometric view of an applicator system 100. As shown, the applicator system 100 comprises of a gripping member 105, a stem 110, and an applicator head 115. The stem 110 has a proximal end and a distal end. The proximal end of the stem 110 is connected to the gripping member 105, while the applicator head 115 is connected to the distal end of the stem 110. Further, as shown in the FIG. 1, the applicator system 100 also comprises of an actuating means 120, the outer interface 120*a* of the actuating means 120 such as a button is formed on the surface of the gripping member 105.

Figure 2:
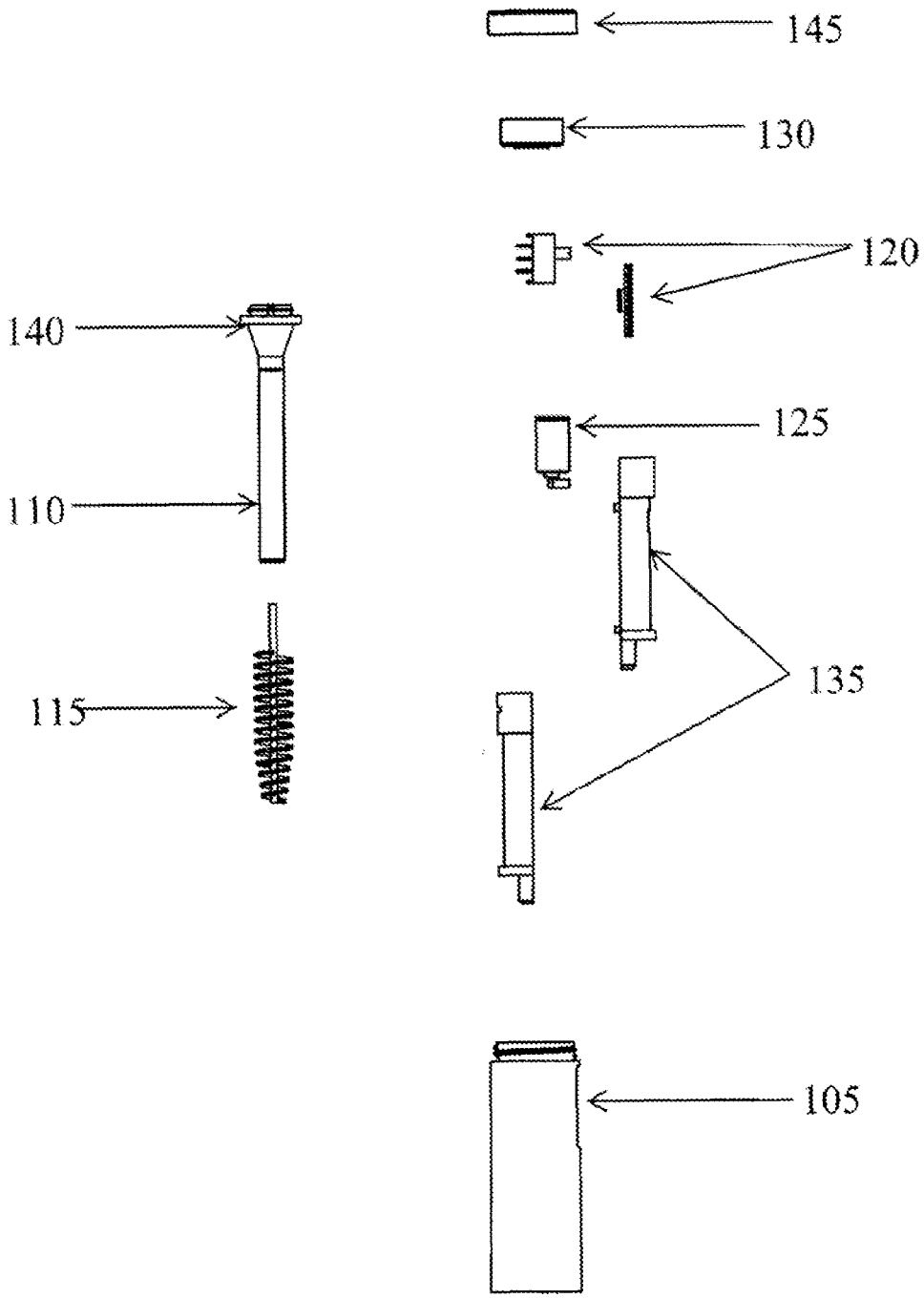
FIG. 2 illustrates an exploded view of the applicator system of FIG. 1.
Figure 3:
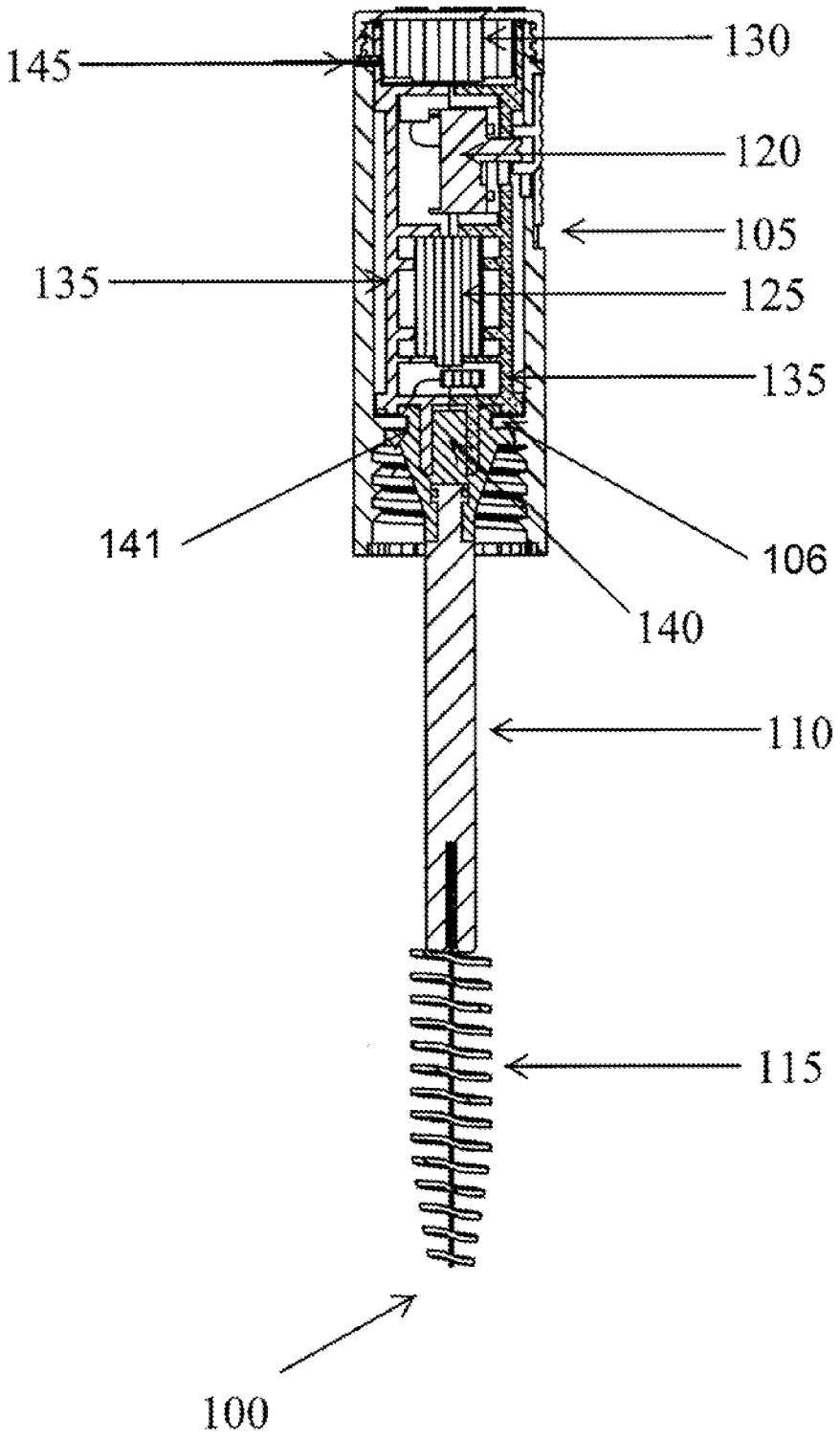
FIG. 3 illustrates a cross-sectional view of the applicator system of FIG. 1.

As represented in FIGS. 2 and 3, the gripping member 105 comprises a hollow chamber 135 which further accommodates a vibration means 125. In the embodiment under consideration, the vibration means 125 includes a vibration motor. Without going beyond the ambit of the present invention, the vibration means 125 may include an electromagnet, a piezoelectric or an ultrasonic vibrator. According to other alternate embodiments of the present invention, the vibration means 125 can be accommodated in the stem 110 or in any other part of the applicator system 100. The hollow chamber 135 further accommodates a power source 130 for the vibrating means 125 such as a battery. According to other alternate embodiments of the present invention, the power source 130 can be accommodated in the stem 110 or in any other part of the applicator system 100. As represented by FIGS. 2 and 3, the proximal end of the vibration means 125 is connected to the actuating means 120. The actuating means 120 when actuated connects the power source 130 and the vibration means 125 which in turn causes the vibrating means to produce vibrations. The hollow chamber 135 is distally connected to the stem 110 by means of a flexible element 140 in the stem 110. In another embodiment of the present invention, the flexible element 140 of the stem 110 may be present as a separate part from the stem 110. In yet another embodiment of the present invention, the distal end of the stem 110 may be connected to the applicator head 115 by means of the flexible element 140. In yet another embodiment of the invention the flexible element 140 may be disposed anywhere in the stem 110, the hollow chamber 135, or any other suitable location that optimally converts the vibration motion of the vibration means 125 into an irregular motion which is further transmitted to the applicator head 115 by any suitable means. In yet another embodiment of the invention, the flexible element 140 can be either an accompanied separate part or replace any of the above following parts, such that it optimally converts the vibration motion of the vibration means 125 into an irregular motion which can further be transmitted to the applicator head 115 by any suitable means.

The gripping member 105 is connected to the stem 110 with the flexible element 140. The gripping member 105 comprises at least one lateral projection 106 which is received into a corresponding groove 141 present in the flexible element 140. The flexible element 140 further encases the proximal end of the stem 110.

Also, there is provided a top cap 145, which is placed above the power source 130, and that provides a suitable outer covering of the gripping member 105.

During usage, as the actuating means 120 is actuated via the outer interface 120*a* (shown in FIG. 1), it turns ON the vibration means 125. The vibration produced by the vibration means 125 propagates onto the hollow chamber 135. Since the distal end of the hollow chamber 135 is connected to the stem 110 by means of a flexible element 140, the flexible element 140 converts the vibration motion caused by the vibration means 125 into an irregular movement of the stem 110. Such an irregular movement of the stem 110 makes the applicator head 115 move in an irregular motion. Such irregular motion of the applicator head 115 during application provides even coating and no clumping of lashes during mascara application.

Figure 4:
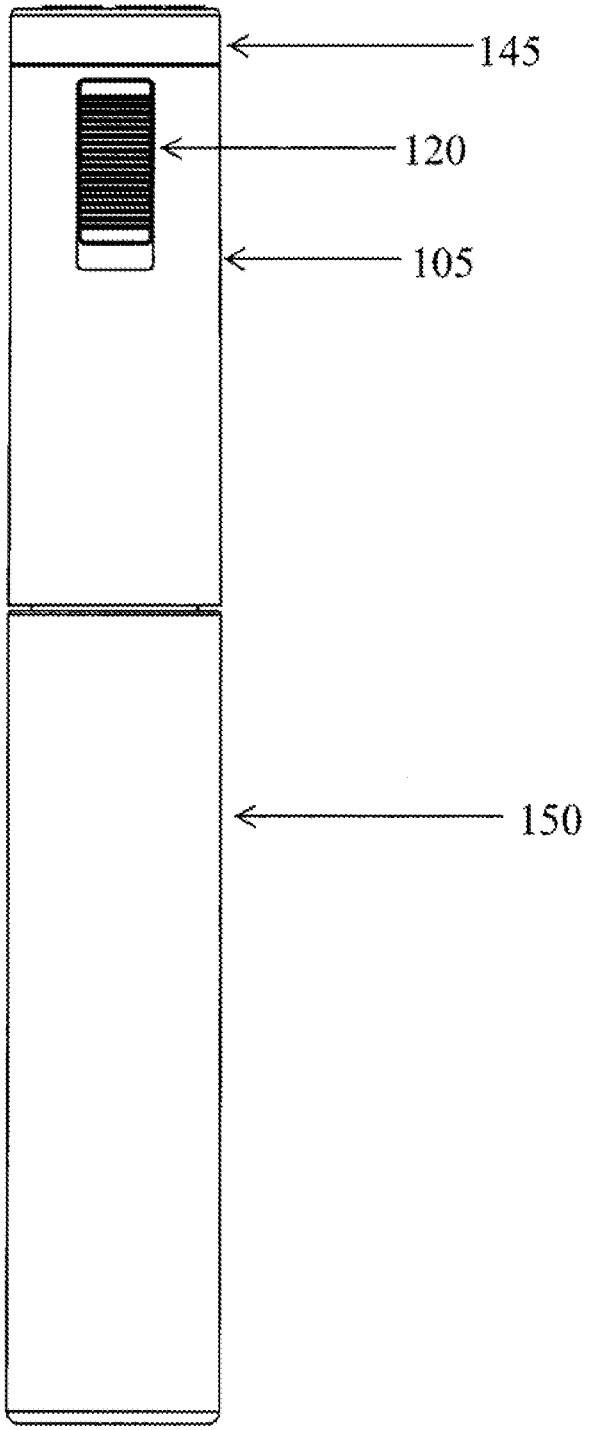
FIG. 4 illustrates the isometric view of a container comprising the applicator system according to an embodiment of the present invention.
Figure 5:
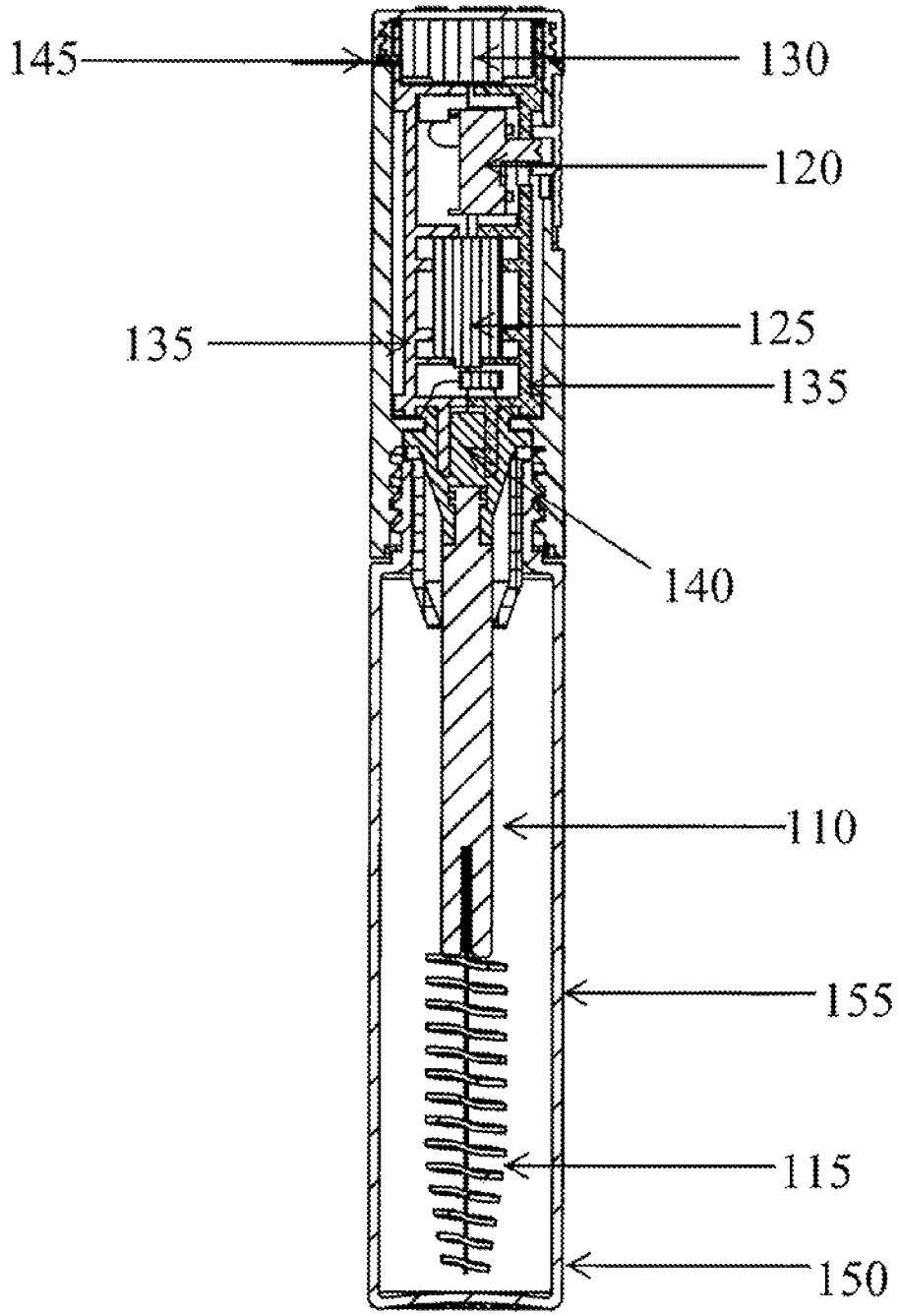
FIG. 5 illustrates a cross-sectional view of the container of FIG. 4.

FIGS. 4 and 5 represent a container comprising the applicator system according to another embodiment of the present invention. The container 150 comprises a receptacle 155 for containing the product and an applicator system 100 as described above.

Figure 6:
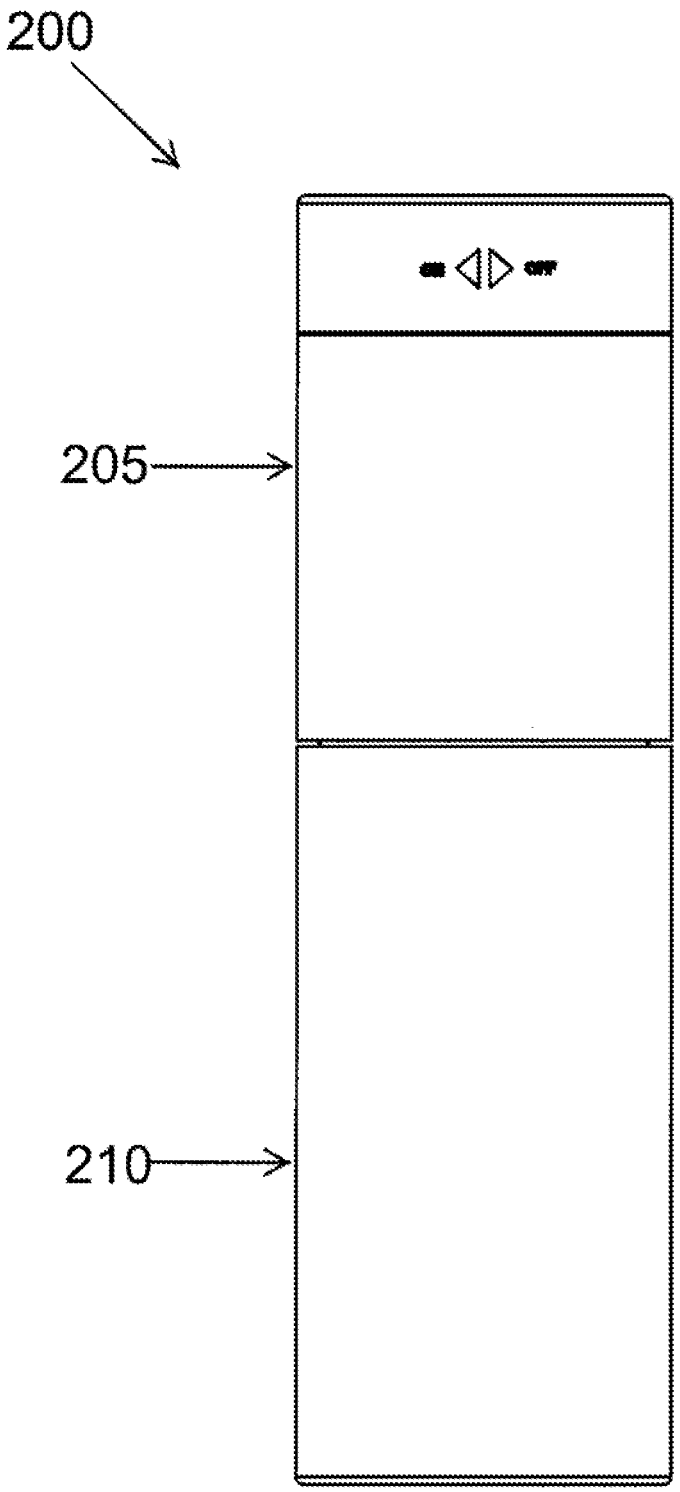
FIG. 6 illustrates the isometric view of a container comprising the applicator system according to another embodiment of the present invention.

FIG. 6 is showing a container 200 comprising the applicator system 205 according to another embodiment of the present invention. The container 200 comprises a receptacle 210 for containing the product and an applicator system 205.

Figure 7:
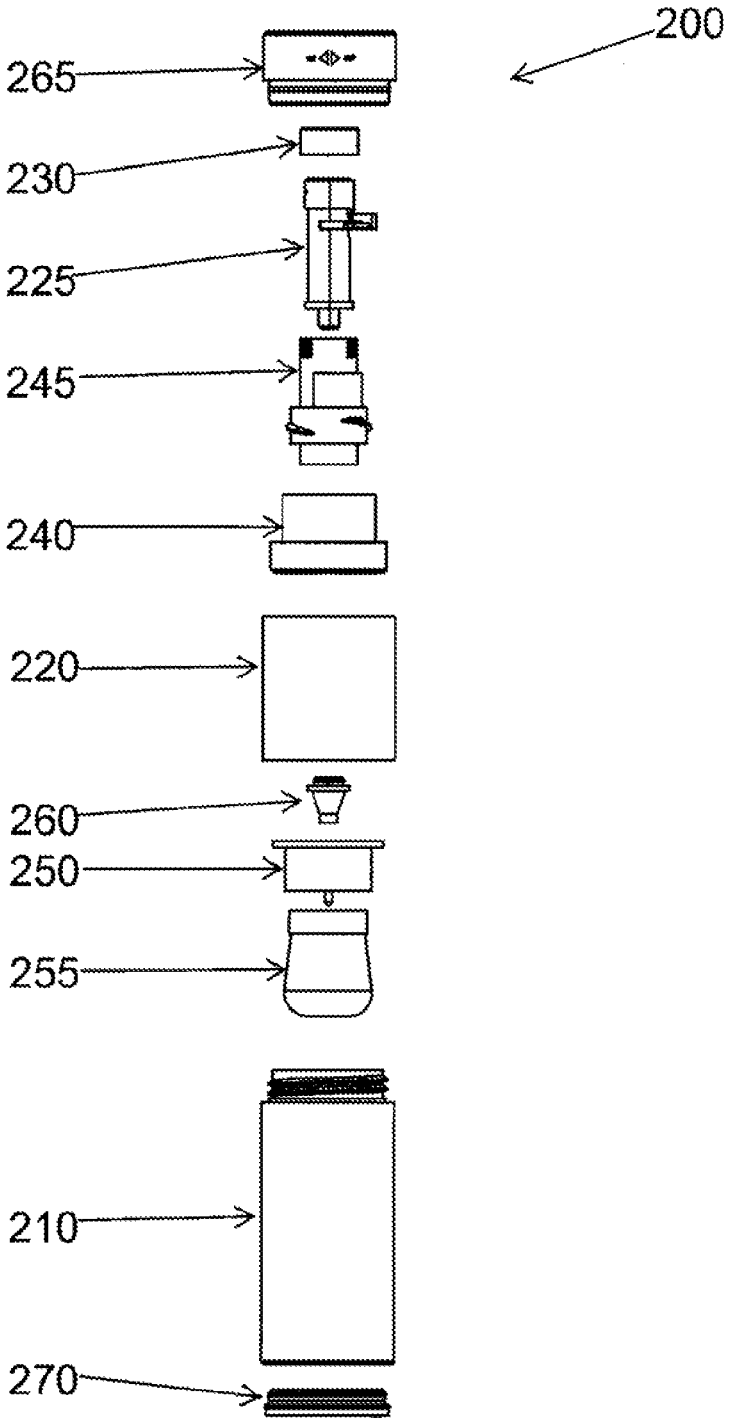
FIG. 7 illustrates an exploded view of the container of FIG. 6.
Figure 8:
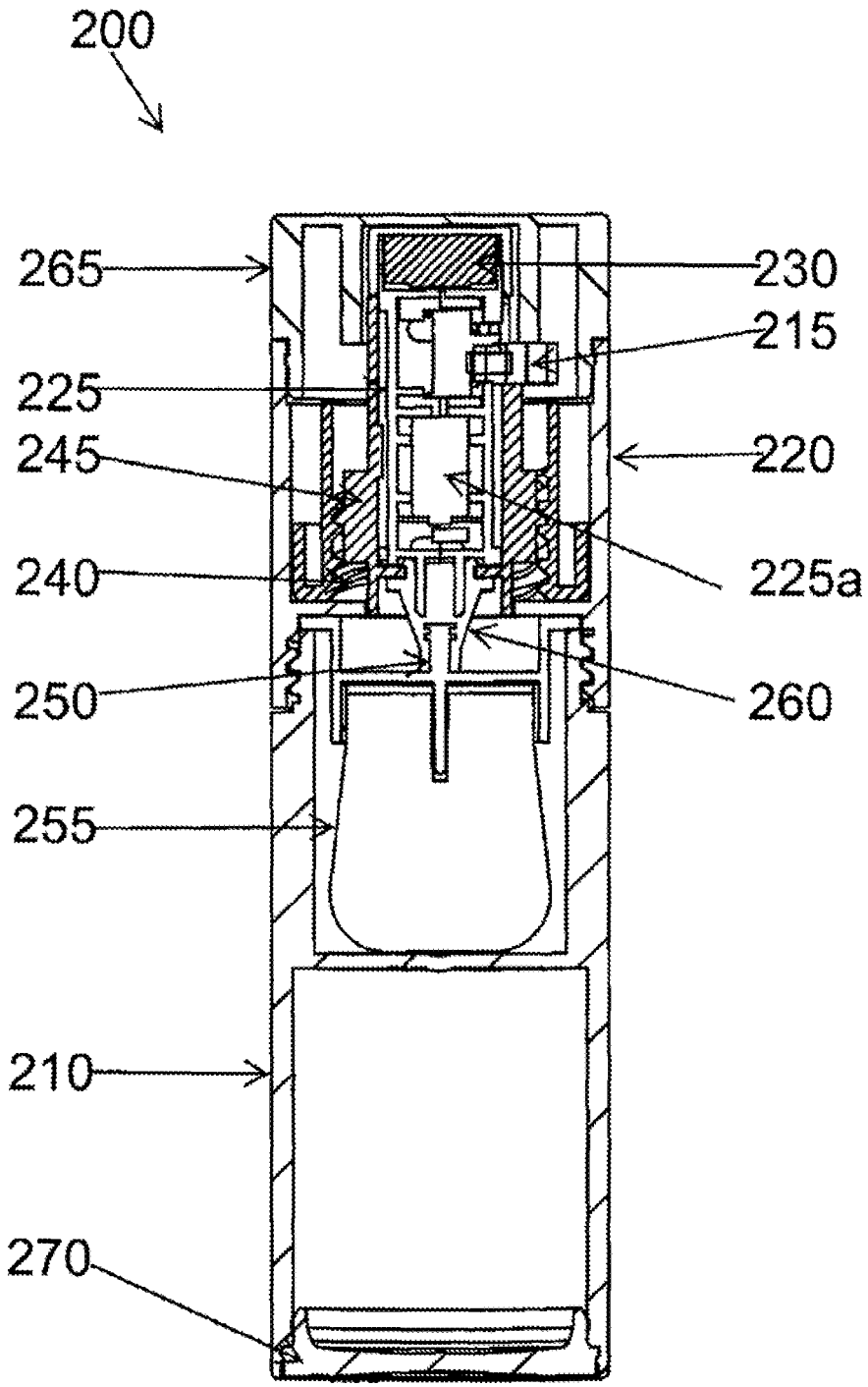
FIG. 8 illustrates a cross-sectional view of the container of FIG. 6.

As represented by FIGS. 7 and 8, the applicator system 205 comprises a gripping member 220 comprising a hollow chamber 225. The hollow chamber 225 houses a vibrating means 225*a* such as a vibration motor or any other suitable means of vibration. Also accommodated in the hollow chamber 225 is a power source for the vibrating means 225*a* such as a battery 230. The hollow chamber 225 of the gripping member 220 further accommodates a propel-repel assembly 235 which comprises a first motion controller 240 and a second motion controller 245. However, the propel-repel assembly 235 is an optional component of the applicator system 205 of the present invention. Further, the propel-repel assembly 235 may comprise a mechanism to propel and repel the applicator. The mechanism to propel and repel the applicator may comprise a slider mechanism, a ball-point mechanism, conventional lipstick mechanism, a threaded screw mechanism or any other suitable mechanism that causes propelling and repelling of the applicator. Furthermore, the propel-repel mechanism of the applicator may be actuated by a suitable actuating means. The actuating means may be the top cap, a dialer, a button, a slider or spring actuated actuator or any other suitable actuating means.

Further, the first and second motion controller 240 and 245 may be connected to each other by screw arrangement or any other suitable arrangement. Further, the first motion controller 240 is arranged to be placed inside the gripping member 220 such that it remains stationary while the second motion controller 245 is arranged to be movable inside the gripping member 220.

As represented by FIGS. 7 and 8, the applicator system 205 further comprises an applicator holder 250, an applicator 255, an actuating means 215 and a flexible element 260. The proximal end of the vibration means 225*a* is connected to the actuating means 215 while the distal end of the vibration means 225*a* is connected to a flexible element 260. The flexible element 260 at its other end is further connected to the applicator holder 250. The applicator holder 250 holds the applicator 255. In another embodiment of the invention the flexible element 260 may be disposed anywhere in the applicator holder 250, hollow chamber 225, or any other suitable location that optimally converts the vibration motion of the vibratory means 225*a* into an irregular motion which can further be transmitted to the applicator 255 by any suitable means. Further, the hollow chamber 225 may be formed of a flexible material such that it functions as a flexible element disposed in the hollow chamber 225. Further, there is provided a top cap 265 that is placed above the power source 230 that provides a suitable outer covering of the gripping member 220. As shown in the FIGS. 7 and 8 the top cap 265 is connected to the gripping member 220 such that the top cap 265 and the gripping member 220 are rotatable with respect to each other. Further, the second motion controller 245 is connected at its proximal end to the top cap 265 while the distal end of the second motion controller 245 is connected to the applicator holder 250. Further, the top cap 265 forms any lock and key arrangement with the second motion controller 245 such that during usage, as the top cap 265 is rotated with respect to the gripping member 220, the second motion controller 245 moves with respect to stationary first motion controller 240 and thereby it causes the applicator holder 250 to move thereby causing the applicator 255 to propel from its storage position. Simultaneously, the actuating means 215 is also actuated upon the rotation of top cap 265 with respect to gripping member 220 and it turns ON the vibration means 225*a* in the present embodiment of the present invention. However in another embodiment of the present invention, the propelling-repelling of the applicator 255 may take place independently of the actuation of the vibration means means 225*a* or any other suitable means. In yet another embodiment of the present invention, the propelling-repelling of the applicator 255 and the actuation of the vibration means may take place simultaneously but there may be provided an external switch in order to actuate or de-actuate the vibration means when the applicator 255 is in storage or extended positions respectively. Further, the vibration produced by the vibration means 225*a* propagates onto the hollow chamber 225. Since the distal end of the hollow chamber 225 is connected to the applicator holder 250 by means of a flexible element 260, the flexible element 260 converts the vibration motion caused by the vibration motor into an irregular motion of the applicator holder 250. Such an irregular motion of the applicator holder 250 makes the applicator 255 move in an irregular motion. The receptacle 210 of the container 200 may further be sealed by a plug 270 at its bottom portion.

Figure 9A:
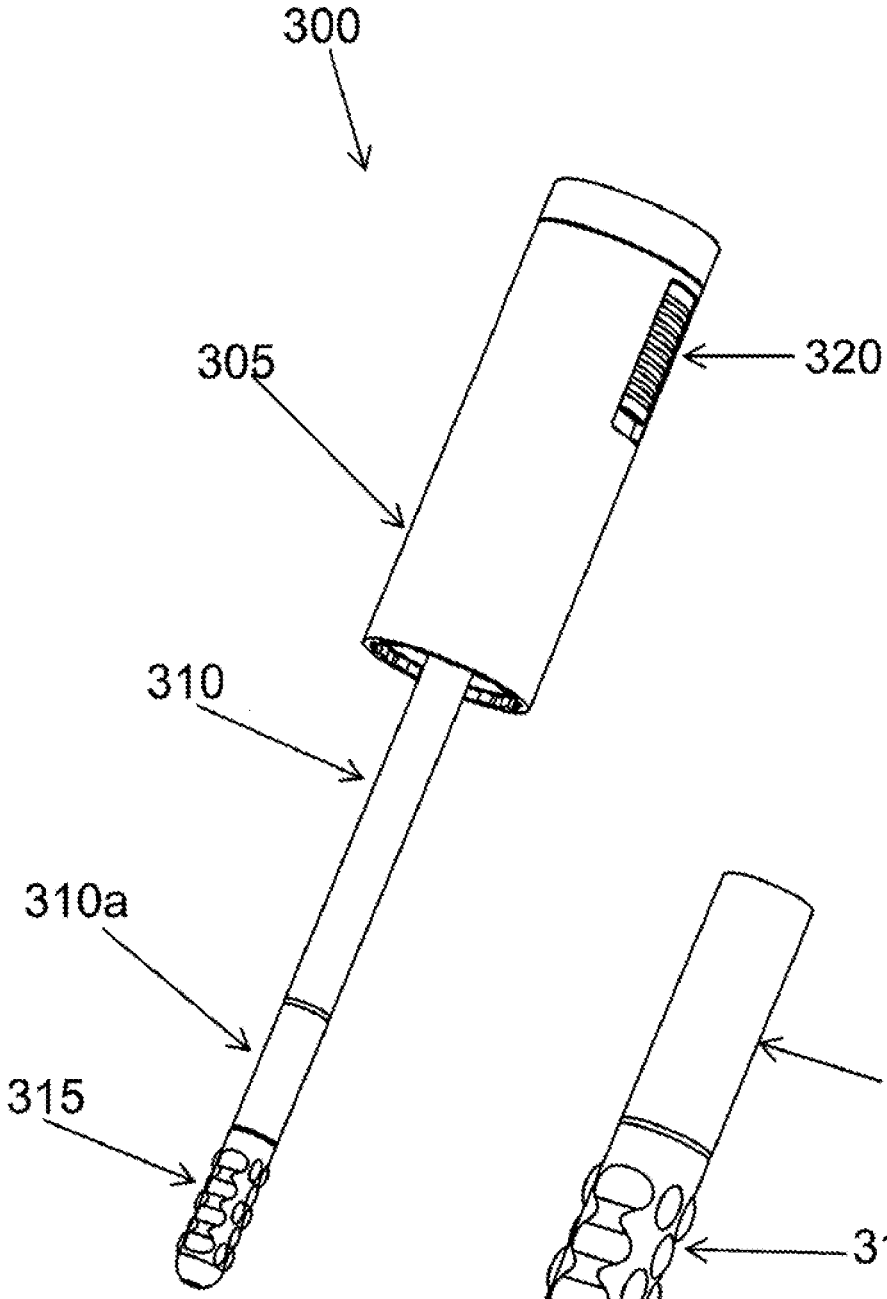
FIG. 9*a* illustrates an isometric view of the applicator system according to yet another embodiment of the invention.
Figure 9B:
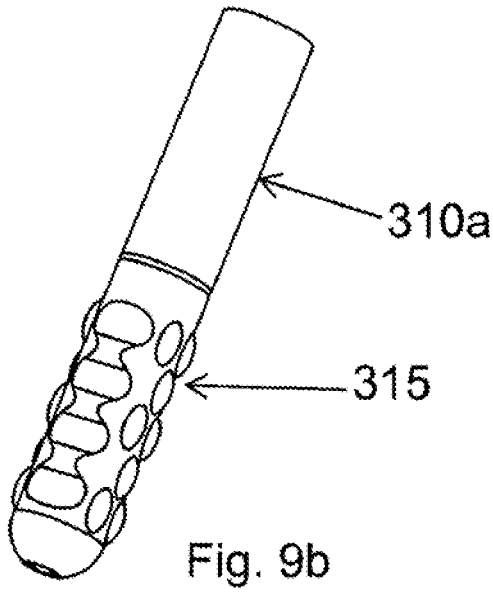
FIG. 9*b* illustrates an isometric view of the applicator head of the applicator system of FIG. 9*a;*

FIG. 9 is another embodiment of the present invention showing an isometric view of the applicator system 300. As shown, the applicator system 300 comprises of a gripping member 305, a stem 310, and an applicator head 315. The stem 310 has a proximal end and a distal end. The proximal end of the stem 310 is connected to the gripping member 305, while the applicator head 315 is connected to the distal end of the stem 310 by means of a stem connector 310 a such that the applicator head 315 is freely rotatable around its axis. Further, as shown in the FIG. 9, the applicator system 300 also comprises of an actuating means 320.

Figure 10:
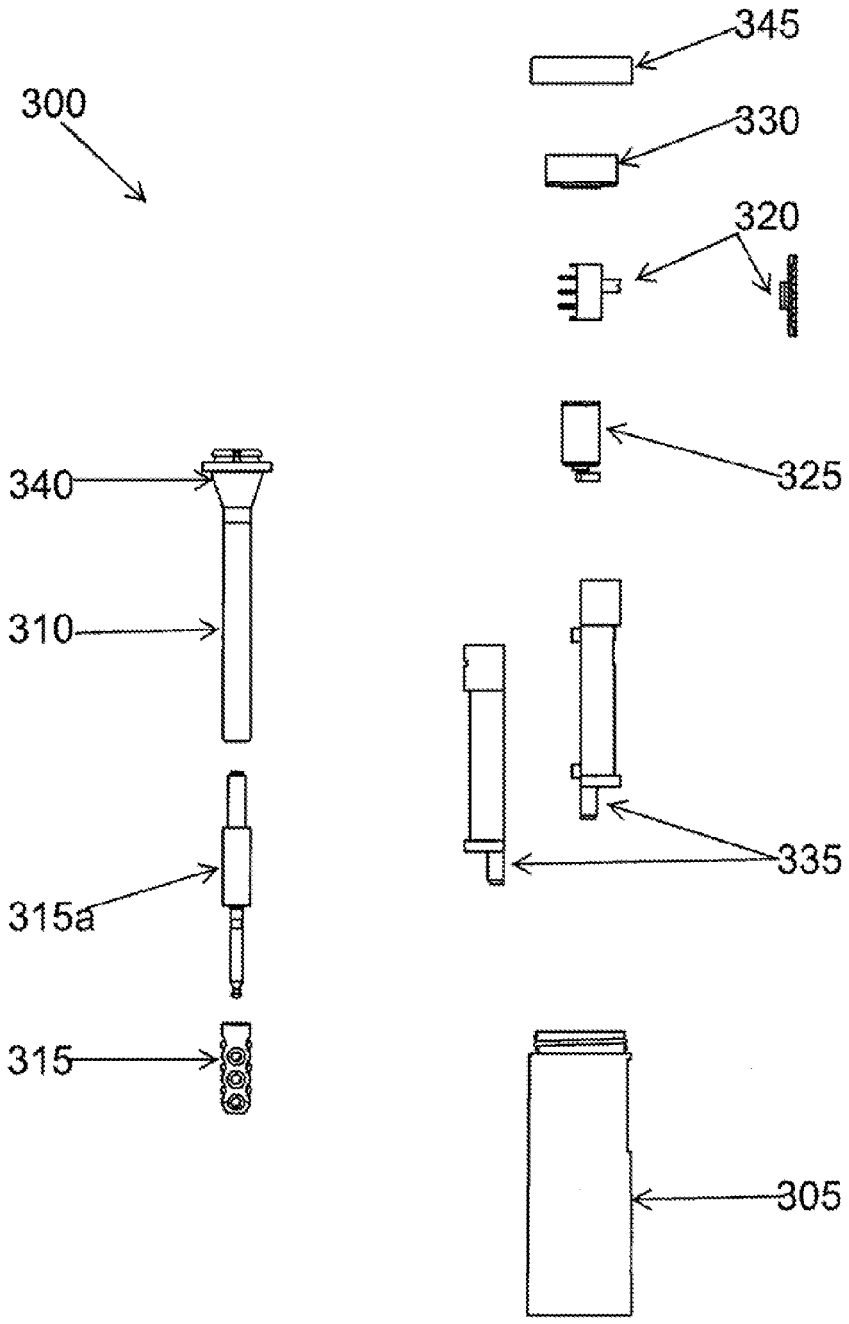
FIG. 10 illustrates an exploded view of the applicator system of FIG. 9*a;*
Figure 11:
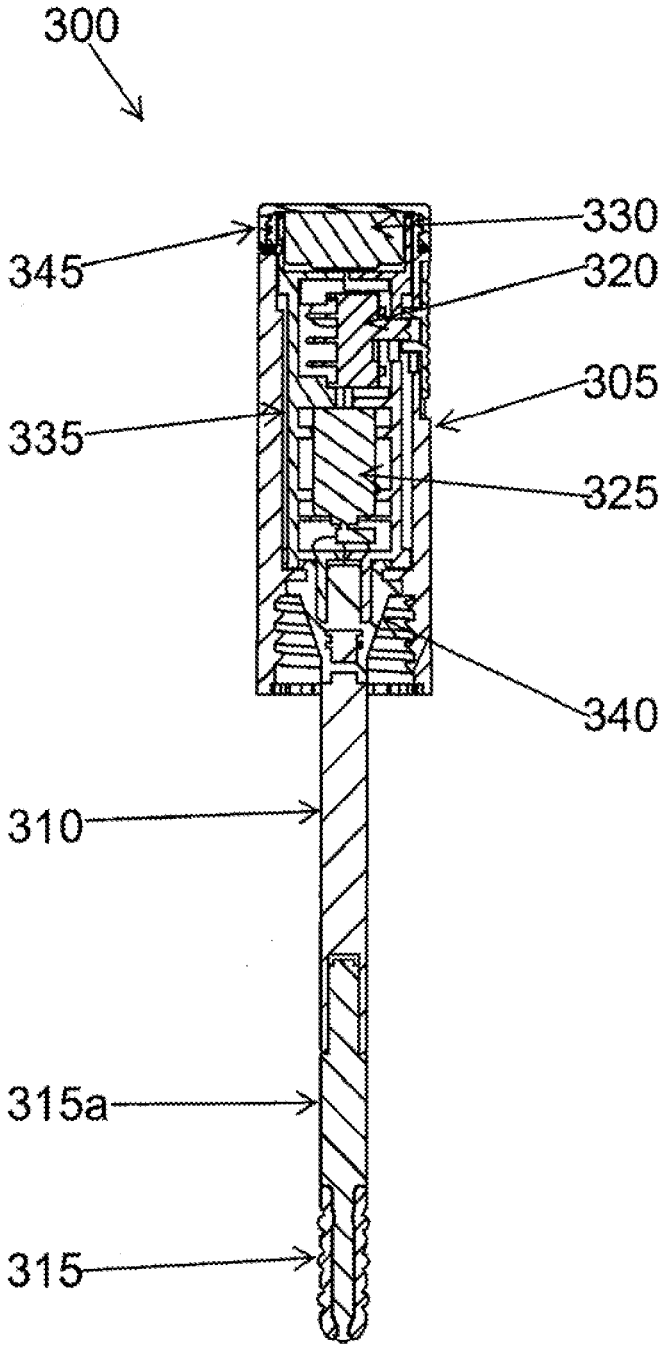
FIG. 11 illustrates a cross-sectional view of the applicator system of FIG. 9*a;*

As represented in FIGS. 10 and 11, the gripping member 305 comprises a hollow chamber 335 in which is accommodated a vibrating means such as a vibration motor 325 or any other suitable means of vibration. Also accommodated in the hollow chamber 335 is a power source 330 for the vibrating means such as a battery. As represented by FIGS. 10 and 11, the proximal end of the vibration motor 325 is connected to the actuating means 320. The actuating means 320 when actuated connects the power source 330 and the vibration motor 325 which in turn causes the vibrating means to produce vibrations. The hollow chamber 335 is distally connected to the stem 310 by means of a flexible element 340 in the stem 310 that optimally converts the vibration motion of the vibratory motor 325 into an irregular motion which is further transmitted to the applicator head 315 by any suitable means. Further, there is provided a top cap 345 that is placed above the power source 330 that provides a suitable outer covering of the gripping member 305.

During usage, as the actuating means 320 is actuated, it turns ON the vibration motor 325. The vibration produced by the vibration motor 325 propagates onto the hollow chamber 335. Since the distal end of the hollow chamber 335 is connected to the stem 310 by means of a flexible element 340, the flexible element 340 converts the vibration motion caused by the vibration motor 325 into an irregular movement of the stem 310. Such an irregular movement of the stem 310 makes the freely rotating applicator head 315 move in an irregular motion. Such irregular motion of the freely rotating applicator head 315 during application provides even coating and also massages the skin simultaneously during application.

Figures 12A, 12B:
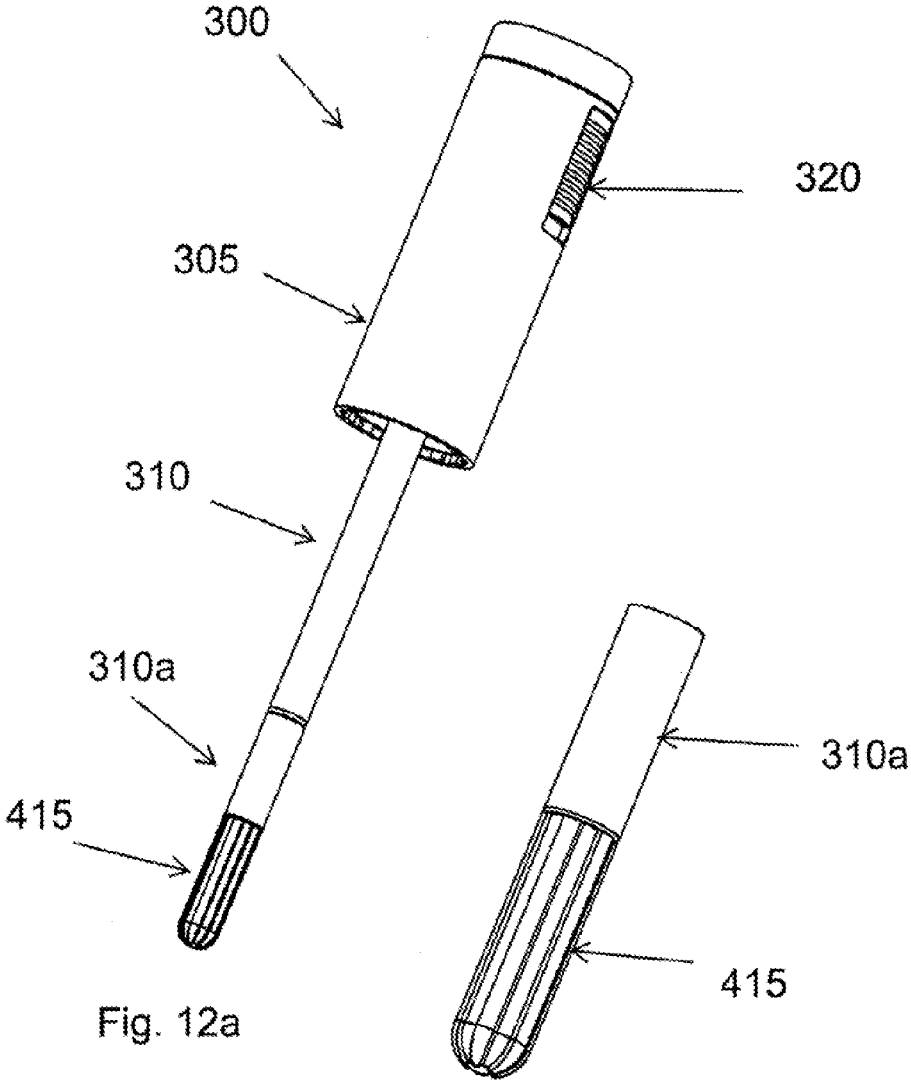
FIG. 12*a* illustrates an isometric view of the applicator system according to yet another embodiment of the invention.
FIG. 12*b* illustrates an isometric view of the applicator head of the applicator system of FIG. 12*a;*
Figure 13A:
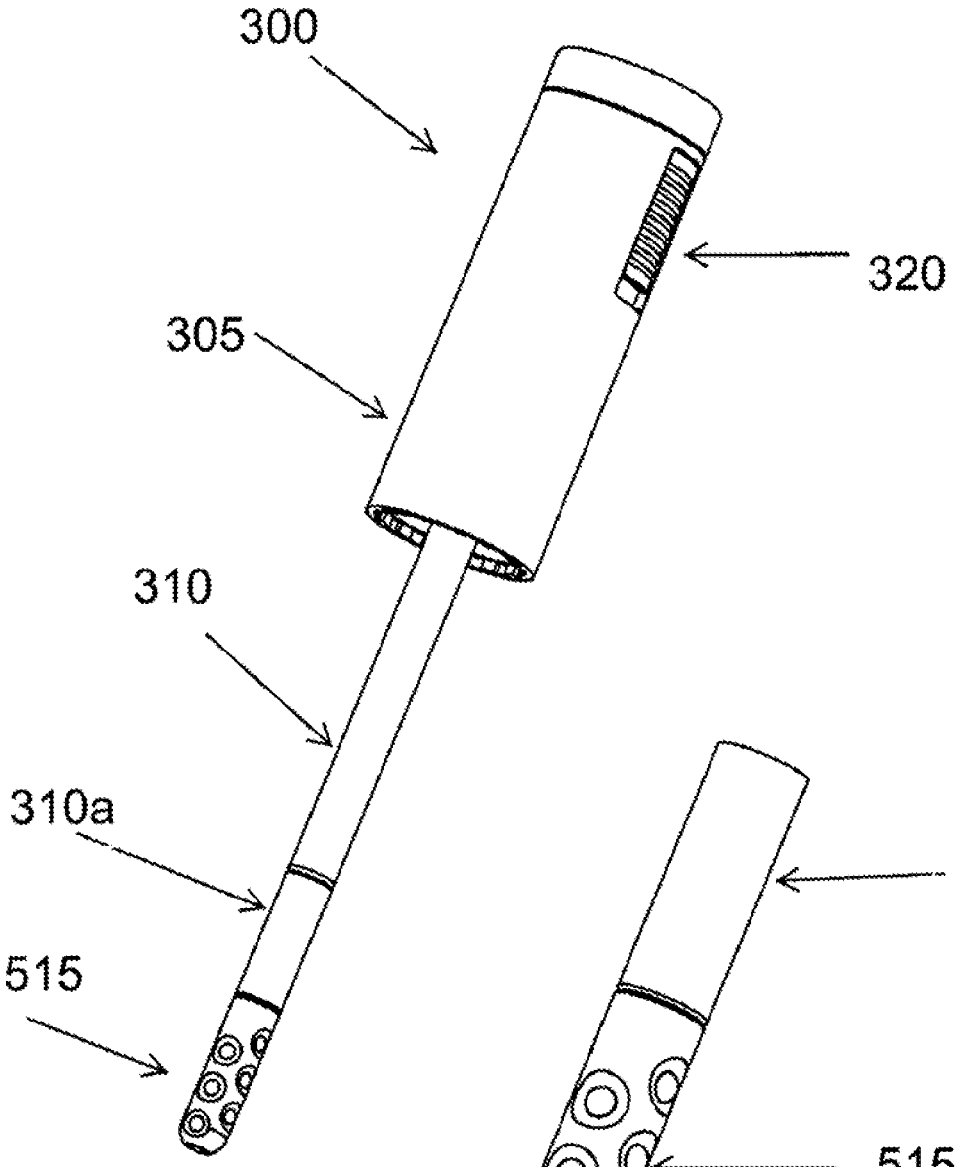
FIG. 13*a* illustrates an isometric view of the applicator system according to yet another embodiment of the invention.
Figure 13B:
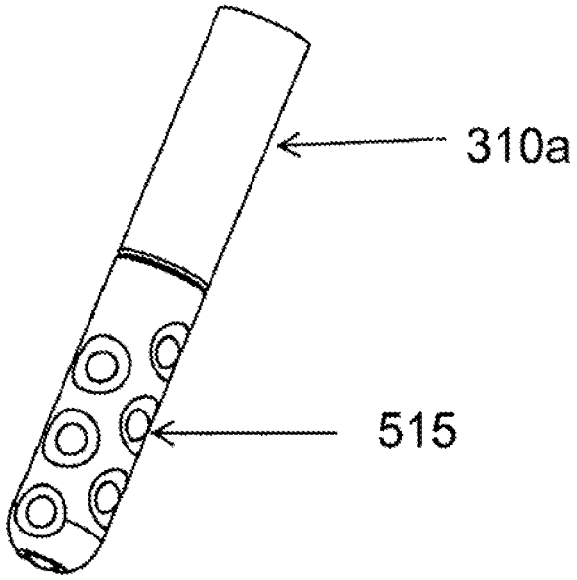
FIG. 13*b* illustrates an isometric view of the applicator head of the applicator system of FIG. 13*a*.

As shown in FIGS. 9 and 9*a* the freely rotating applicator head 315 may comprise a plurality of cavities to carry the product and further include contours that aid in application as well as massaging while application. In accordance with another embodiment of the present invention, the applicator head 115, 315 may be provided with a plurality of projections, ribs, ridges, embossments, depressions, grooves, or any other suitable feature that assist in better application of the product. FIGS. 12*a* and 12*b* represent an exemplary embodiment of the present invention showing the different profiles of the applicator head 415. Further, FIGS. 13*a* and 13*b* also represent an exemplary embodiment of the present invention showing the different profiles of the applicator head 515.

Although the above description shows the container being cylindrical, the shapes and profiles cross section thereof are not limited to the same.

The body of the applicator system and the container according to the invention may be formed of a polymeric material such as PCTA, polypropylene, however other suitable materials may also be used.

The container of the present invention may be used to store a wide variety of consumer and industrial products related to cosmetic, skin care, hair care, oral care, personal care, pharmaceutical, wound care, orally administrable products, home-care or adhesives. Various examples of the products where the cosmetic container of the present invention could be used are but not limited to cheek blush, cheek plumping gel/cream, lip plumping gel/cream, moisturizer, sunscreen, temporary hair colors, hair styling gel, hair mousse, hair repair cream, hydrating cream, antiseptic and correction cream, acne treatment cream, concealer, blemish concealer, skin treatment cream, hair repair cream, anti-dandruff cream, hair treatment serum, scalp hydrating oils, teeth whitening gel, teeth whitening and teeth lamination solutions, pain relieving cream, antibiotic cream and analgesic cream, antipyretic and analgesic serums/solutions, bleaching agent, fabric softener, stain remover, bleaching agent, adhesive gels, loose powder, baked or pressed product, mascara, lip product, etc. While the foregoing is directed to embodiments of the present invention, other and further embodiments of the invention may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. An applicator system comprising of a gripping member, a stem having a proximal end and a distal end,
an applicator head connected to the distal end of the stem,
a vibration means; and
at least one flexible element;
wherein the gripping member comprises a hollow chamber having a top wall, at least one side wall extending downwardly from the top wall and a bottom wall;
wherein the at least one side wall of the hollow chamber is encased by a side wall of the gripping member;
wherein the hollow chamber is distally connected to the stem by the at least one flexible element;
wherein the at least one flexible element is positioned below the bottom wall of the hollow chamber;
wherein the hollow chamber and the proximal end of the stem are not in physical contact with each other;
wherein the hollow chamber includes an annular extension at its distal end and wherein the annular extension extends downwardly from the bottom wall of the hollow chamber;
wherein the annular extension and the proximal end of the stem are encased within the at least one flexible element;
wherein the vibration means is disposed between a proximal end of the gripping member and a distal end of the applicator head; and
wherein the vibration means is a piezoelectric vibrator.

2. The applicator system according to claim 1 further comprising a power source.

3. The applicator system according to claim 2 further comprising an actuating means connected to the vibration means, wherein the actuating means when actuated connects the power source and the vibration means to produce vibrations.

4. The applicator system according to claim 1 wherein the stem is formed by a combination of flexible elements and rigid elements in a suitable sequence.

5. The applicator system according to claim 1 wherein the applicator head is stationary.

6. The applicator system according to claim 1 wherein the applicator head is movably disposed.

7. The applicator system according to claim 1 wherein the applicator head is configured to apply consumer and industrial products.

8. The applicator system of claim 7 wherein the applicator head comprises at least one of a plurality of cavities, a plurality of projections, ribs, ridges, embossments, depressions, or grooves to carry the product and contours to aid in application of the product.

9. The applicator system of claim 7 wherein the applicator head is constructed of a porous or non-porous rubber, fabric mesh, felt material, foamed polymers, sponge material, Hytrel™ or TPE.

10. An applicator system comprising of
a gripping member;
a stem having a proximal end and a distal end, the stem comprising at least one flexible portion;
an applicator head connected to the distal end of the stem;
a vibration means;
wherein the gripping member comprises a hollow chamber having a top wall, at least one side wall extending downwardly from the top wall, and a bottom wall;
wherein the at least one side wall of the hollow chamber is encased by a side wall of the gripping member;
wherein the hollow chamber has an annular extension at its distal end and wherein the annular extension extends downwardly from the bottom wall of the hollow chamber;
wherein the annular extension is encased within the at least one flexible portion;
wherein the at least one flexible portion is positioned below the bottom wall of the hollow chamber; and
wherein the vibration means is disposed between a proximal end of the gripping member and a distal end of the applicator head.

11. An applicator system comprising of
a gripping member;
a stem having a proximal end and a distal end;
an applicator head connected to the distal end of the stem;
a vibration means;
at least one flexible element;
wherein the gripping member comprises a hollow chamber having a top wall, at least one side wall extending downwardly from the top wall and a bottom wall;
wherein the at least one side wall of the hollow chamber is encased by a side wall of the gripping member;
wherein the hollow chamber is distally connected to the stem by the at least one flexible element;
wherein the at least one flexible element is positioned below the bottom wall of the hollow chamber;
wherein the hollow chamber and the proximal end of the stem are not in physical contact with each other;
wherein the hollow chamber includes an annular extension at its distal end and wherein the annular extension extends downwardly from the bottom wall of the hollow chamber; the annular extension having a proximal end and a distal end;
wherein the annular extension and the proximal end of the stem are encased within the at least one flexible element;
wherein the distal end of the annular extension and the proximal end of the stem are in close proximity to each other but are not in physical contact with each other; and
wherein the vibration means is disposed between a proximal end of the gripping member and a distal end of the applicator head.

12. The applicator system according to claim 11 wherein the vibration means comprises a vibration motor, an electromagnet, a piezoelectric or an ultrasonic vibrator.

* * * * *